United States Patent [19]

Kassner et al.

[11] Patent Number: 4,650,370

[45] Date of Patent: Mar. 17, 1987

[54] HIGH-SPEED CABLE-LAYING APPARATUS

[75] Inventors: Harry W. Kassner; Robert G. Draney, both of Wichita; Stephen A. Youngers, Clearwater, all of Kans.

[73] Assignee: J. I. Case Company, Racine, Wis.

[21] Appl. No.: 818,807

[22] Filed: Jan. 14, 1986

[51] Int. Cl.[4] ..... E02F 5/02

[52] U.S. Cl. ..... 405/183; 405/179; 405/180; 37/191 A; 173/63; 173/100

[58] Field of Search ..... 405/174, 175, 176, 177, 405/178, 179, 180, 181, 182, 183; 37/191 A, 192 A, 86; 173/33, 63, 100

[56] References Cited

U.S. PATENT DOCUMENTS

| | | | |
|---|---|---|---|
| 3,203,188 | 8/1965 | Evans | 405/179 |
| 3,332,249 | 7/1967 | Idoine | 405/179 |
| 3,777,500 | 12/1973 | Kelley | 405/180 |
| 3,831,299 | 8/1974 | Kelley | 37/193 |
| 3,834,049 | 9/1974 | Bond | 37/86 |
| 4,539,765 | 9/1985 | Reece | 405/179 |

FOREIGN PATENT DOCUMENTS

| | | | |
|---|---|---|---|
| 446596 | 10/1974 | U.S.S.R. | 405/174 |

*Primary Examiner*—Cornelius J. Husar
*Assistant Examiner*—Kristina I. Hall
*Attorney, Agent, or Firm*—Peter N. Jansson

[57] ABSTRACT

An improved high-speed cable-laying apparatus of the type which digs a kerf, lays a cable at the kerf bottom, and refills the kerf with spoil in one pass. The kerf digger is a chainline loop having ground-cutting teeth spaced along its length and restricting elements between the teeth. The chainline is preferably in the form of a narrow upright loop. Rearwardly of the chainline loop are an upright chute for directing cable to the bottom of the kerf and a trailing structure supporting a reel, cable guide means, and angled plow blades for directing spoil back into the kerf on top of the cable. The arrangement of elements is compact and maneuverable and avoids damage to fragile cable even while the device operates at high ground speed.

11 Claims, 3 Drawing Figures

HIGH-SPEED CABLE-LAYING APPARATUS

FIELD OF THE INVENTION

This invention is related generally to cable-laying apparatus and, more particularly, to apparatus for high-speed one-pass laying of fragile cable such as fiber optics cable and the like.

BACKGROUND OF THE INVENTION

In the prior art there are a number of devices which have been developed to facilitate cable-laying operations. Some of these devices combine two or three of the principal functions which are involved in cable laying, including trenching or otherwise opening a kerf, placing a cable at the bottom of the kerf, and refilling the kerf. However, devices of the prior art have a number of disadvantages and drawbacks.

Some of these disadvantages and drawbacks are experienced most severely when such equipment is used for laying relatively fragile cable of small diameter. Laying fiber optics cable can be particularly troublesome. This invention is particularly concerned with solving such problems, and with laying cable in kerfs of narrow width, such as two inches or less. But the invention is useful for laying cable of various kinds.

Fiber optics cable cannot reliably withstand either excessive vibration or so-called "back bending." Excessive vibration can break fibers and thus diminish or break the fiber optical qualities essential to signal transmission in such cable. Excessive vibration is a particular problem for such cable when it is in firm contact with hard surfaces or edges as may be the case when cable is being directed into a kerf.

Cable damage can also be caused by "back-bending" which occurs when insufficient care is given to the manner in which cable is unwound from a reel or when an excessive length of cable is exposed to various pressures, such as pulling and/or unreeling pressures. After being reeled on a cylindrical reel for a period of time, cable can take a kind of "set" which makes bending in the opposite direction, or "back-bending," harmful. Back-bending can destroy fiber optical qualities at the point of bending.

Various cable-laying systems of the prior art cause such vibration and/or back bending and have shown themselves to be disadvantageous in laying fragile cable such as fiber optics cable.

Among the many prior patents disclosing cable-laying operation are the following:

U.S. Pat. No. 3,203,188 (Evans)
U.S. Pat. No. 3,332,249 (Idoine)
U.S. Pat. No. 3,998,065 (Darnell)
U.S. Pat. No. 4,539,765 (Reece)
U.S. Pat. No. 3,788,575 (Boettcher et al.)
U.S. Pat. No. 3,874,182 (Potter et al.)
U.S. Pat. No. 4,040,261 (Schuck et al.)
U.S. Pat. No. 4,038,828 (Schuck et al.)
U.S. Pat. No. 3,405,533 (Fries)
U.S. Pat. No. 3,926,263 (Frisbee et al.)
U.S. Pat. No. 4,119,157 (Schuck et al.)
U.S. Pat. No. 3,931,717 (Schuck)
U.S. Pat. No. 3,948,059 (Pompa)
U.S. Pat. No. 3,618,237 (Davis)
U.S. Pat. No. 3,363,423 (Davis)
U.S. Pat. No. 3,926,004 (Baylor)
U.S. Pat. No. 4,162,087 (Avrillon)

Many of these patents deal with wide-trenching devices having massive rock wheels which are prone to excessive vibration. Many also have long spans of cable from a remote location or a run of unguided cable extending toward the trench bottom. Such lack of cable control can lead to back-bending and other cable movement which may be deleterious to the cable.

A number of these patents, including those which are used to open a relatively narrow kerf, have vibrating trench cutters. Such vibratory cutters can cause damage to fiber optics cable. This is particularly the case when such vibrating devices are closely adjacent to a guide element or other element in contact with the cable.

Cable guide members are highly desirable for minimizing back-bending, but when such elements are vibrating excessively by virtue of the nature of the kerf digger, cable damage may not be avoidable.

A particular disadvantage of certain apparatus of the prior art, particularly those devices having vibratory trench cutters, is that they are not capable of digging sufficiently deep kerfs unless excessive power is used. And the deeper they dig, the greater the level of excessive vibration with all the attendant problems for fiber optics cable.

To overcome some of these problems, multiple-pass cable laying methods have often been used for laying fiber optics cable. This, of course, makes the cable-laying operations very time-consuming and expensive.

The dominant speed of prior multi-function cable-laying apparatus is slow. This is often due to the problems associated with trench digging. There has been a need in the art for improved one-pass cable-laying apparatus which can move at higher speeds along the ground.

Many devices of the prior art which carry out two or three of the primary cable-laying functions are very large and complex and are difficult to operate and maneuver. There has been a need for a compact and maneuverable one-pass cable-laying apparatus. There has also been a need for a simple and reliable one-pass cable-laying apparatus.

In particular, there has been a need for an improved cable-laying apparatus which preserves the integrity of fragile cable such as fiber optics cable.

BRIEF SUMMARY OF THE INVENTION

This invention is an improved apparatus for laying cable which overcomes certain problems and deficiencies of the prior art, including those mentioned above. The apparatus includes a chainline ground cutter, as will be further described, for digging a kerf, means to supply cable to the kerf bottom, and means to refill the kerf with spoil. The apparatus of this invention can perform the principal cable-laying functions in one pass.

The device for kerf opening is a continuous chainline, which can cut ground to substantial depths at relatively high ground speeds compared to various other trench diggers in the prior art. The chainline is a circumferentially-driven loop which has cutting teeth spaced along its length to cut the ground and restricting means between such teeth to restrict the degree of ground penetration by each successive tooth.

The particular characteristics of the teeth along the chainline do not form part of this invention. However, such teeth have ground-cutting distal edges which extend from the chain to cut the ground has they pass in rapid succession against the ground during the rapid circumferential movement of the chainline loop.

The restricting means between the teeth of such chainline are preferably non-cutting bar elements which serve to clear out spoil which has been loosened by the teeth. The bar elements have distal ends extending to lesser distal dimensions than the cutting teeth. By such dimensioning, such bar elements will not encounter much uncut ground as the chainline loop moves around the chainline support means. Furthermore, such bar elements or other restricting means will prevent excessive ground penetration by each successive tooth as the chainline travels along the loop, and, in so doing, will prevent the chainline from jamming or stalling as the cable-laying apparatus of this invention moves in a forward direction.

The chainline is supported on, and moves at high speed along, a chainline support means. Such support means is one or more planar elements which are of narrow dimension, narrower than the chainline itself so that it will not interefere with movement of the chainline loop through the ground.

The chainline support means, which may include driving sprocket(s), preferably has upper and lower ends which support the chainline is a substantially upright loop. In such orientation, the chainline loop has front and rear spans extending between the ends of the chainline support means. The front and rear spans are closely spaced—by a distance less than the distance between the ends of the chainline support means.

In preferred embodiments, a substantially upright cable chute is secured immediately adjacent to and rearwardly of the upright chainline loop. The chute has a cable-dispensing opening at its lower end, horizontally adjacent to the lower end of the chainline loop and positioned at the bottom of the kerf which has just been cut. The chute has a cable-receiving opening at its opposite (upper) end. The chute is preferably secured by a connector element to the chainline support means.

In preferred embodiments, a trailing structure is secured adjacent to and rearwardly of the cable chute, and the cable supply means includes a reel support means attached to such trailing structure adjacent to and immediately behind the cable-receiving opening of the chute. The positioning of a cable reel on such support means, preferably in an orientation with the reel axis horizontal and across the direction of movement of the cable-laying apparatus such that the cable will come off the reel in a forward direction from the top of the reel, is particularly helpful in minimizing cable damage, as hereafter will be explained.

Preferred embodiments also include a substantially horizontal guide element between the cable-receiving opening and the reel and positioned just above a tangent line extending from the reel to the cable-receiving opening. Such cable guide element is preferably mounted on the trailing structure. The reel and its support means, the horizontal guide element, and the chute form means to supply cable to the kerf bottom in undamaged condition.

As previously noted, excessive bending is deleterious to certain types of cable, such as fiber optics cable. Having taken a "set" based on the normal curvature of the reel on which it was stored, the cable can be straightened without damaging it but bending it in the reverse direction damages it. But the cable-handling apparatus of this invention, particularly the rearward location of the reel support means and the reel thereon, the way the reel is arranged with respect to the cable-receiving opening on the chute, and the cable guide element and its positioning tend to minimize cable damage by eliminating significant cable back-bending. This arrangement of the cable-handling elements of this invention allows the cable to be removed from the reel and reach the kerf bottom with minimal changes in its orientation.

In highly preferred embodiments, the substantially upright cable chute is tilted in a forward direction such that cable exiting the cable-dispensing opening along the bottom of the kerf is directed substantially rearwardly at that point. In this highly preferred embodiment, the cable reel, cable guide and chute form a generally U-shaped path for cable which conforms generally to the direction of the cable "set." This arrangement minimizes the strains of cable bending during unreeling and laying.

In such embodiments it is highly preferred that the chainline loop also be tilted forward and generally parallel to the chute. This adds compactness to the multi-function structure of the apparatus of this invention. And, it is highly preferred in such embodiments that a connector element engage the trailing structure at a position which is forward of (and, of course, above) the cable-dispensing opening of the chute so that the reel secured to the trailing structure is aligned substantially above the cable-dispensing opening. This combination of a forwardly tilted chainline loop and chute with the trailing structure provides a particularly compact and maneuverable one-pass cable-laying apparatus.

In preferred embodiments, the refilling means is a ground-adjacent plow means which is rigidly attached to the trailing structure and angled toward the kerf. Such plow means, which is preferably a pair of mirror-image plow blades, will engage the spoil, which has fallen adjacent to the kerf by operation of the chainline digging device, and guide it laterally until it falls into the kerf to cover the cable and fill the kerf. Such action occurs as the cable-laying apparatus of this invention moves in a forward direction.

The method of powering this cable-laying apparatus is not a part of this invention. However, it is preferred that the apparatus be pulled by a tractor and that a power take-off from such tractor be used to drive the chainline ground cutter. Such power take-off can be in a variety of forms which are well known to those skilled in the art.

OBJECTS OF THE INVENTION

It is the primary object of this invention to provide a cable-laying apparatus of the type having means to dig a kerf, supply cable to the kerf bottom, and refill the kerf, which overcomes certain problems and deficiencies of prior apparatus.

Another object of this invention is to provide a one-pass cable-laying apparatus which can operate at relatively high ground speeds.

Another object of this invention is to provide a cable-laying apparatus which can operate at high ground speed while laying cable to substantial depths.

Another object of this invention is to provide an improved multi-function cable-laying apparatus which minimizes or eliminates cable damage, such as damage caused by excessive vibration, back-bending and the like.

Another object of this invention is to provide a one-pass cable-laying apparatus which is simple in structure and operation and may be powered and propelled by a general purpose tractor.

Another object of this invention is to provide a cable-laying apparatus which is compact and maneuverable.

These and other objects of the invention will be apparent from the following description of preferred embodiments and from the drawings wherein:

DETAILED DESCRIPTIONS OF PREFERRED EMBODIMENTS

Figure 1:
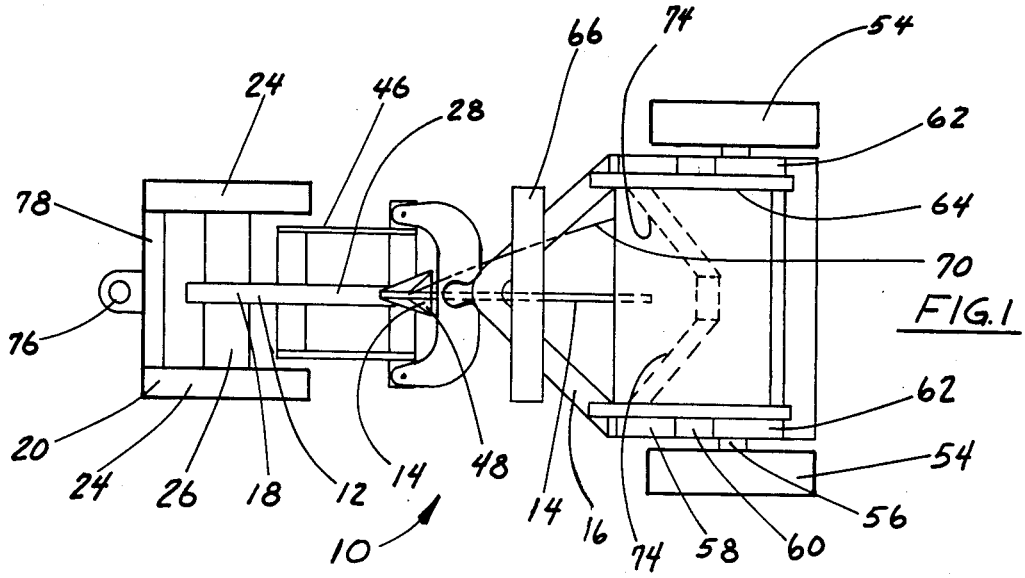
FIG. 1 is a plan view of a cable-laying apparatus in accordance with this invention.

The drawing shows a cable-laying apparatus 10 having three major structures in a particular arrangement. These include a trench cutter 12, an upright cable chute 14, and a trailing structure 16.

Trench cutter 12 includes a continuous cutting chainline loop 18, a chainline support means 22, and a carrier frame 20. Carrier frame 20 has parallel side members 24 and a shaft 26 extending between them. Shaft 26 supports an upper end portion (not shown) of chainline support means 22. The upper end portion may be a driving sprocket. Shaft 26 may also include power take-off means (not shown) by which chainline loop 18 is circumferentially driven.

In addition to its upper end portion, chainline support means 22 also includes an upright member 30 and, at the lower end of upright member 30, is lower end portion 32. Lower end portion 32 may be an idling sprocket. At an intermediate location along upright member 30 is a middle supporting portion 34 of chainline support means 22. Middle supporting portion 34, like lower end portion 32, may be an idling sprocket which serves to hold chainline 18 reasonably taut and which provides cutting support against the ground.

Figure 2:
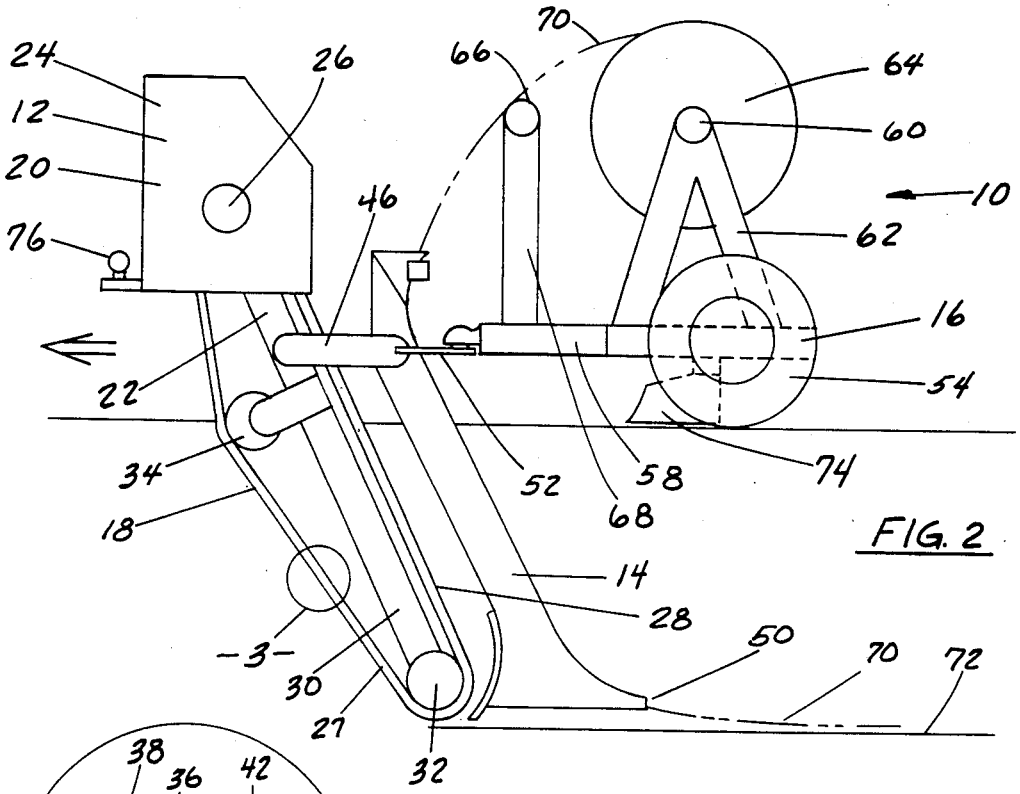
FIG. 2 is a side elevation.
Figure 3:
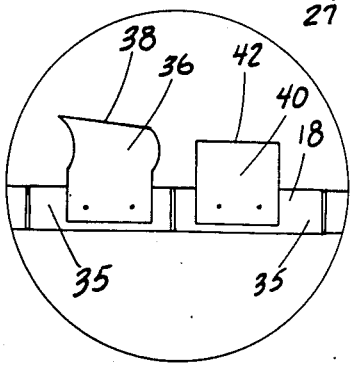
FIG. 3 is a magnified fragmentary view as indicated in FIG. 2.

Certain details of chainline 18 are illustrated in FIG. 3, but not in FIGS. 1 and 2. Chainline 18 is preferably made of a number of metal links. On alternate links all around chainline 18 are cutting teeth 36, which extend to distal cutting edges 38 as illustrated in FIG. 3. Distal cutting edges 38 are the portions of chainline 18 which project farthest from chain links 35. Between each pair of cutting teeth 36, one on every other chain link, is a bar element 40 which serves the purposes noted above. Bar elements 40 have distal ends 42 which extend to lesser distal dimensions than the distal cutting edges 38 of teeth 36. Bar elements 40, cutting teeth 36, and chain links 35 to which they are mounted are made of hardened materials capable of withstanding the friction caused by ground cutting. Cutting teeth 36 and bar elements 40 are made of hardened materials.

Chainline loop 18 has a front span 27 and a rear span 28 which are closely spaced. Chainline loop 18, while substantially upright, is tilted in a forward direction.

A connector element 46 is forked over and secured to upright member 30 and joins upright cable chute 14 to the trench cutting structure. Chute 14 has a cable-receiving opening 48 at its upper end and a cable-dispensing opening 50 at its lower end. Chute 14 is narrow in order to easily be received within the narrow kerf cut by chainline loop 18, but cable receiving opening is flared to readily accommodate cable received from different positions along a reel without exerting unnecessary force on it.

Cable-dispensing opening 50 is horizontally adjacent to and immediately behind lower end portion 32 of chainline support means 22, positioned to be at the kerf bottom 72. Chute 14, while substantially upright, is tilted forwardly and generally parallel with chainline loop 18 and closely adjacent to it, an orientation providing some of the advantages described above.

Connector element 46, previously mentioned, has a rearwardly extending portion 52 to which trailing structure 16 is attached. Trailing structure 16 includes two wheels 54 supported on either end of an axis 56 and a horizontal frame 58. A cable reel support spindle 60 extends between two vertical members 62 and supports a reel 64 immediately behind cable-receiving opening 48 of chute 14. Located between reel 64 and cable-receiving opening 48 is a horizontal cable guide element 66 which is attached to trailing structure 16 by a post 68. Guide element 66 is positioned just above a tangent line which extends from reel 64 to cable-receiving opening 48.

By virtue of the forward tilt of chute 14, and the forward position at which trailing structure 16 is secured to chute 14, reel 64 is aligned substantially above cable-dispensing opening 50 of chute 14. As previously described, this arrangement of parts is particularly advantageous in protecting fragile cable.

Cable 70 comes off reel 64 at an upper tangent point and in a forward direction. It passes over horizontal guide element 66 and into cable-receiving opening 48. The orientation of chute 14, horizontal guide element 66 and reel 64 allows cable 70 to be laid at kerf bottom 72 without undergoing back-bending. During such operation and by virtue of the arrangement of elements, cable 70 follows a generally U-shaped path which is off-straight in the direction that the cable has been stored on its reel.

Rigidly secured to the underside of horizontal frame 58 of trailing structure 16 are a pair of plow blades 74 which are positioned in mirror-image fashion on opposite sides of the open kerf. Plow blades 74 are very closely adjacent to the ground and are angled toward the kerf. During forward movement of the apparatus of this invention, this orientation of plow blades 74 causes them to engage the spoil piled adjacent to the kerf and direct it back into the kerf. In this manner the kerf is refilled.

The apparatus of this invention may be pulled by a tractor by attachment to a hitch 76 carried by a crossbar 78 which is attached to carrier frame 20. A wide variety of other means may be provided for propulsion by a separate vehicle, or the device, including the chainline, may be combined with and driven by a committed prime mover.

The elements and parts of this invention may be made of materials which are well known to those skilled in the art.

While the principles of this invention have been described in connection with specific embodiments, it should be understood clearly that these descriptions are made only by way of example and are not intended to limit the scope of the invention.

What is claimed:

1. In cable-laying apparatus of the type having means to dig a kerf, means to supply cable to the kerf bottom, and means to refill the kerf with spoil, the improvement comprising:

the digging means being a forward-tilting chainline loop on a chainline support means having upper and lower ends, the upper end being forward of the lower end;

a substantially upright cable chute secured adjacent to and rearwardly of the loop, said chute having a cable-dispensing opening horizontally adjacent to said lower end and a cable-receiving opening at its opposite end, at least a portion of said opposite end being forward of said lower end;

a trailing structure secured adjacent to and rearwardly of said opposite end of the chute, said trailing structure having ground-engaging means, a reel support means adjacent to the cable-receiving opening, and a ground-adjacent refilling plow; and connection means engaging the trailing structure at a position forward of the cable-dispensing opening such that a reel on the reel support means is substantially vertically aligned with the cable-dispensing opening, whereby the apparatus is compact and easy to maneuver.

2. The cable-laying apparatus of claim 1 wherein said chainline has cutting teeth spaced along its length and means between the teeth to restrict ground penetration of each successive tooth, thereby to facilitate ground speed of the apparatus.

3. The apparatus of claim 2 wherein said restricting means are bar elements having distal ends of lesser distal dimension than said teeth.

4. The apparatus of claim 1 wherein said chute is secured by a connector element to said chainline support means.

5. The apparatus of claim 4 wherein said chute, said chainline support means, and said trailing structure are secured together by said connector element.

6. The apparatus of claim 1 wherein said chute is oriented such that cable exiting therefrom is directed substantially rearwardly at the cable-dispensing opening.

7. The apparatus of claim 1 wherein said cable supply means further includes a substantially horizontal guide element between said cable-receiving opening the reel on said reel support means and positioned just above a tangent line extending from said reel to said cable-receiving opening, whereby bending of the cable may be minimized.

8. The apparatus of claim 7 wherein said reel, guide element and chute form a generally U-shaped path for cable whereby cable bending may be minimized during unreeling and laying.

9. The apparatus of claim 1 wherein said refilling plow is angled toward said kerf, whereby forward movement of said trailing structure will engage said plow against spoil piled adjacent to the kerf to direct it back into the kerf.

10. The apparatus of claim 9 wherein the plow comprises a pair of substantially mirror-image plow blades, one on either side of the kerf.

11. The apparatus of claim 1 wherein the ground-engaging means are wheels.

* * * * *